US006417811B1

(12) United States Patent
Adrian

(10) Patent No.: US 6,417,811 B1
(45) Date of Patent: Jul. 9, 2002

(54) IN-GLASS ANTENNA ELEMENT MATCHING

(75) Inventor: Andrew Adrian, Dexter, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/821,889

(22) Filed: Mar. 30, 2001

(51) Int. Cl.[7] ..... H01Q 1/32; H01Q 13/10
(52) U.S. Cl. ..... 343/713; 343/767; 343/861
(58) Field of Search ..... 343/711, 712, 343/713, 767, 770, 860, 861

(56) References Cited

U.S. PATENT DOCUMENTS

| | | | | |
|---|---|---|---|---|
| 4,954,797 A | | 9/1990 | Shinnai et al. | 343/704 |
| 5,101,212 A | | 3/1992 | Shinnai et al. | 343/713 |
| 5,231,410 A | | 7/1993 | Murakami et al. | 343/713 |
| 5,239,303 A | | 8/1993 | Hirotsu et al. | 343/713 |
| 5,355,144 A | * | 10/1994 | Walton et al. | 343/713 |
| 5,610,618 A | | 3/1997 | Adrian et al. | 343/713 |
| 5,936,585 A | | 8/1999 | Hall | 343/713 |
| 5,940,042 A | * | 8/1999 | Van Hoozen | 343/713 |
| 5,999,134 A | | 12/1999 | Dishart et al. | 343/713 |
| 6,215,450 B1 | * | 4/2001 | Oka | 343/713 |
| 6,243,043 B1 | * | 6/2001 | Terashima et al. | 343/713 |
| 6,292,149 B1 | * | 9/2001 | Endo et al. | 343/713 |

* cited by examiner

*Primary Examiner*—Tan Ho
(74) *Attorney, Agent, or Firm*—Brinks Hofer Gilson & Lione

(57) ABSTRACT

An in-glass antenna system for a window with adjustable impedance for impedance matching. The in-glass antenna system includes an in-glass slot antenna that is defined by an upper portion, a lower portion and two respective side portions. An in-glass impedance matching circuit is connected to the slot antenna, wherein the impedance matching circuit adjusts the impedance of said slot antenna.

18 Claims, 2 Drawing Sheets

IN-GLASS ANTENNA ELEMENT MATCHING

FIELD OF THE INVENTION

The present invention generally relates to automobile antenna systems, and, more particularly, to a method and system of providing three additional dimensions of freedom to an in-glass antenna that facilitates impedance matching of the in-glass antenna.

BACKGROUND OF THE INVENTION

Automobile FM radio receivers typically use monopole antenna structures, such as mast or telescoping whip antennas, to provide an acceptable level of reception of radio signals in a moving motor vehicle. The downfall with these antennas is that the extension of these antennas from the body of the motor vehicle exposes the antenna to damage or contact with debris during travel. In addition, these types of antenna designs detract from the overall appearance of the motor vehicle, induce wind noise and often include expensive systems that are used to retract the antenna into the body of the motor vehicle when not in use to protect the antenna from damage.

Concealed or conformal antennas, such as those embedded in windows of motor vehicles, have been used to overcome these problems. U.S. Pat. No. 5,610,618, to Adrian et al., discloses an automobile antenna system that uses a conductive trace that is placed within a portion of the glass of an automobile window lite. As set forth in greater detail below, the present invention may be used in an antenna system like that disclosed in U.S. Pat. No. 5,610,618 and, as such, this patent is hereby incorporated by reference in its entirety for background purposes only.

Concealed antennas are difficult to design to meet the same level of quality of conventional monopole aerial antennas. One reason for this is because impedance matching concealed antennas with the radio receiver of the motor vehicle can be difficult. The performance of an antenna is in large part determined by its impedance match with the radio receiver. In designing antennas for use in motor vehicles, it is important to match the impedance of the radio system components and, in particular, to match the impedance of the radio, the antenna and the feed line between the two components. A mismatch in impedance can result in a significant loss of radio signals.

To that end, a need exists for a system and method of providing an in-glass or concealed antenna that is capable of providing an impedance match with the remaining portion of the radio system.

SUMMARY OF THE PRESENT INVENTION

The preferred embodiment of the present invention discloses an in-glass antenna system that includes adjustable impedance for impedance matching the in-glass antenna system with a radio receiver in a motor vehicle. The in-glass antenna system includes an in-glass slot antenna that is defined by an upper portion, a lower portion and two respective side portions. An in-glass impedance matching circuit is connected to the slot antenna, wherein the impedance matching circuit is capable of adjusting the impedance of the in-glass slot antenna.

The preferred in-glass impedance matching circuit comprises an in-glass conductive trace that is connected to a predetermined point on, preferentially, the antenna feed structure within the in-glass slot antenna. The in-glass conductive trace runs substantially parallel with the upper portion of the in-glass slot antenna. In the preferred embodiments of the in-glass antenna system, three elements of the in-glass conductive trace may be adjusted to adjust the impedance of the in-glass slot antenna. Controlling these three parameters allows a reliable impedance match between the in-glass antenna system and the radio receiver to be obtained.

The first element or parameter that can be adjusted is the spacing of the conductive trace from the opposite portion of the in-glass slot antenna to which the in-glass conductive trace is connected to the in-glass slot antenna. Second, the length of the in-glass conductive trace can also be adjusted to adjust the impedance of the in-glass slot antenna. Third, the width of the in-glass conductive trace can be adjusted to adjust the impedance of the in-glass slot antenna.

Yet another embodiment of the present invention discloses a method of impedance matching an in-glass antenna system for a window with a radio receiver. In this preferred method, an in-glass slot antenna is provided that includes an in-glass antenna conductive trace that runs substantially parallel with a horizontal plane of the window. An in-glass conductive trace is connected to the in-glass antenna conductive trace that runs substantially parallel with a horizontal plane of the window for a predetermined distance. A first end of the in-glass conductive trace is grounded to the lower portion of the in-glass slot antenna and a second end of the in-glass conductive trace is used as a signal transmission output line.

The impedance of in-glass slot antenna can be adjusted by adjusting the predetermined distance, the spacing of the in-glass conductive trace from an edge of the window and the width of the in-glass conductive trace.

The case where the conductive trace matching circuit is connected to the lower portion of the in glass antenna is subsequently described and illustrated, however, the scope of the invention is not solely limited to this case as mentioned above. Further objects and advantages of the present invention will be apparent from the following description, reference being made to the accompanying drawings wherein preferred embodiments of the present invention are clearly shown.

DETAILED DESCRIPTION OF THE PREFERRED EMBODIMENTS OF THE INVENTION

The present invention discloses a motor vehicle antenna system that is preferentially installed in a windshield or backlite of a motor vehicle. As used herein, the term window should be construed broadly to include any type of window, including, but not limited to, windshields or backlites of motor vehicles. The FM broadcast band has a one-half wavelength of approximately 1.4 to 1.75 meters. Thus, the antenna systems disclosed herein are readily positioned along a lower or, more preferably, upper horizontal region of the windshield or backlite, as set forth in detail below. Those skilled in the art would recognize that the antenna system disclosed herein may be installed in various other structures, such as boats by way of example only.

The discussion that follows begins with a general background on prior art motor vehicle in-glass antenna systems, then proceeds with a detailed discussion of the preferred embodiment of the present invention. The purpose of briefly discussing the prior systems is to help facilitate a better understanding of the invention disclosed herein.

Figure 1:
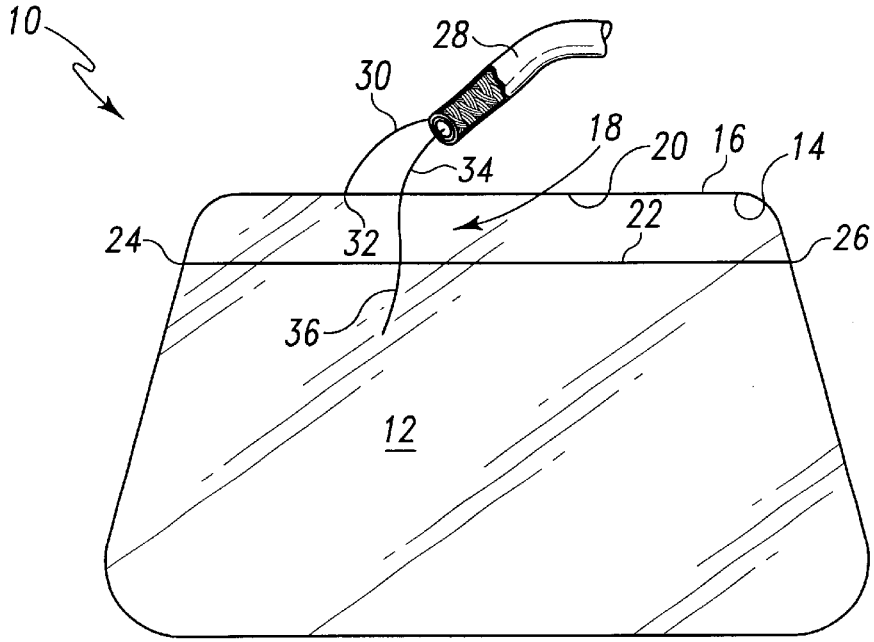
Fig. 1 (Prior Art)
FIG. 1 illustrates a prior in-glass antenna system.

Referring to FIG. 1, a prior art vehicle antenna system 10 is illustrated that is installed in a window 12 of a motor vehicle (not illustrated). The window 12 is preferentially installed in a window opening 14 of the motor vehicle that includes an electrically conductive periphery 16. A slot antenna 18 is defined in part by an upper horizontal portion 20 of the electrically conductive window periphery 16. The slot antenna 18 is further defined by an in-glass antenna conductive trace 22, which is integral with the window 12. The in-glass antenna conductive trace 22 is seen to extend horizontally, substantially parallel to the upper horizontal portion 20 of the perimeter of the window 12, from a first side point 24 to an opposite second side point 26. As such, the preferred slot antenna 18 is conformal in that its componentry conforms to, or substantially lies in, the curvoplanar shape of the vehicle body, since it is substantially in the plane of the window 12.

The preferred slot antenna 18 has a horizontal length equal to one-half a wavelength in the FM broadcast frequency band. Its vertical dimension, referred to here as the width of the slot antenna 18, is substantially less than the length of the antenna, preferably being 10 percent to 15 percent of its length. The in-glass antenna conductive trace 22 can be provided, for example, as an electrically conductive film deposited on an inside surface of the outer or inner glass panes laminated to form a typical motor vehicle windshield. The in-glass antenna conductive trace 22 preferably comprises a metal film, which, in certain preferred embodiments, is substantially transparent to visible light. The metallized film may be covered by or sandwiched between protective films of metal oxide or the like. Such films and film stacks may be formed in accordance with techniques well known for producing electrically heated glazing panels.

The two side points 24, 26 of the in-glass antenna conductive trace 22 are connected to the electrically conductive periphery 16 of the windshield opening 14. It should be understood that the periphery of the window 12 may include a metal frame element, conductive adhesive material used to mount the window 12 in the window opening 14, or even an equivalent conductive member, such as a conductive strip extending circumferentially in or on the windshield proximate its peripheral edge.

In the embodiment illustrated in FIG. 1, the side points 24, 26 of the in-glass antenna conductive trace 22 forms an electrical junction with the electrically conductive periphery 16 of the vehicle body using wire interconnects and ground lugs in accordance with known techniques. Thus, the electrically conductive periphery 16 cooperates with the in-glass antenna conductive trace 22 interconnected by ground lugs at the two side points 24, 26 to form a substantially rectangular slot antenna 18 approximately one-half wavelength long at the FM broadcast band.

In the prior art system illustrated in FIG. 1, an electrical lead 28 is provided for carrying signals from the slot antenna 18 to a radio receiver or an antenna module (neither illustrated) in the motor vehicle. The electrical lead 28, which is preferably a coaxial cable, includes a first conductor 30 that is preferably the outer sheath of the coaxial cable. The first conductor 30 is connected to the electrically conductive periphery 16 of the window opening 14, preferably to the upper horizontal portion 20 at a first electrical junction 32. A second conductor 34 of the electrical lead 28 is coupled to the in-glass antenna conductive trace 22 of the slot antenna 18. In the embodiment illustrated in FIG. 1, the second conductor 34 comprises the center wire of elecrical lead 28 that extends coaxially within the electrical lead 28. The second conductor 34 forms a second electrical junction 36 with the antenna conductive trace 22 at approximately the center of the antenna conductive trace 22. As previously illustrated in the prior art from U.S. Pat. No. 5,610,618, to Adrian et al., the second electrical conductor 34 could also connect to a feed structure within the slot antenna.

Although not illustrated in FIG. 1, as briefly set forth above, in prior glass antenna systems 10, the electrical lead 28 is connected to some sort of an antenna module (not illustrated) that is, in turn, connected to the radio receiver of the motor vehicle. In these systems, sophisticated impedance matching circuitry is often included in the antenna module, or as a separate circuit in some antenna systems, to help impedance match the antenna system 10 with the radio receiver for maximum power transfer.

As set forth in detail below, the present invention discloses a method of adding three additional dimensions of freedom to an in-glass antenna system that facilitates impedance matching the antenna system with a radio receiver. This is accomplished by using an in-glass impedance matching circuit that is connected to the antenna system. As further set forth below, the preferred in-glass antenna system also has the benefit of allowing the implementation of alternate locations for an antenna feed line and a ground line, thereby allowing flexibility in determining the position of the electrical lead 28.

Figure 2:
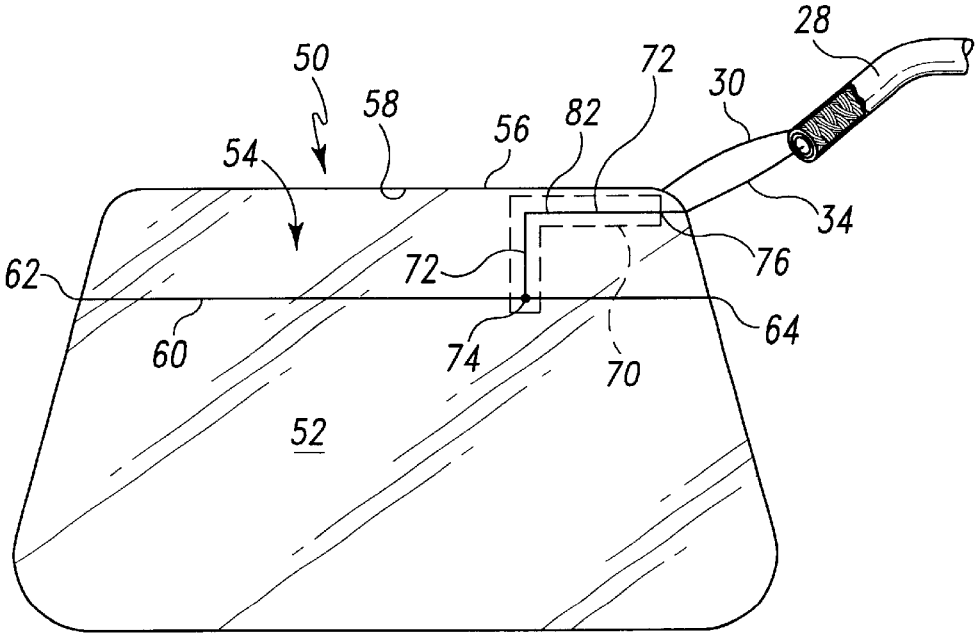
FIG. 2 illustrates an in-glass antenna system that includes an in-glass adjustable impedance circuit.

Referring to FIG. 2, the present invention discloses an in-glass antenna system 50 that is preferentially designed for a window 52 of a motor vehicle. The preferred in-glass antenna system 50 includes a means for adjusting the impedance of the in-glass antenna system 50 to facilitate impedance matching the in-glass antenna system 50 with a radio receiver of a motor vehicle (neither illustrated). Impedance matching is important because it provides for maximum power transfer or minimum reflection of radio signals received by the in-glass antenna system 50. As such, the input impedance of the preferred in-glass antenna system 50 is capable of being adjusted, in-glass, so that the radio receiver can abstract the maximum amount of received energy from the in-glass antenna system 50.

In the preferred embodiment of the present invention, the in-glass antenna system 50 includes a slot antenna 54. The preferred slot antenna 54 is defined in part by an electrically conductive window periphery 56. The slot antenna 54 is also defined in part by an upper horizontal portion 58 of the electrically conductive window periphery 56. The slot antenna 54 is further defined by an in-glass antenna conductive trace 60, which is integral with the window 52. The in-glass antenna conductive trace 60 is seen to extend horizontally, substantially parallel to the upper horizontal portion 58 of the perimeter of the window 52, from a first side point 62 to an opposite side point 64. As illustrated in FIG. 2, the in-glass antenna conductive trace 60 is spaced a predetermined distance from the upper horizontal portion 58 of the electrically conductive window periphery 56.

Figure 3:
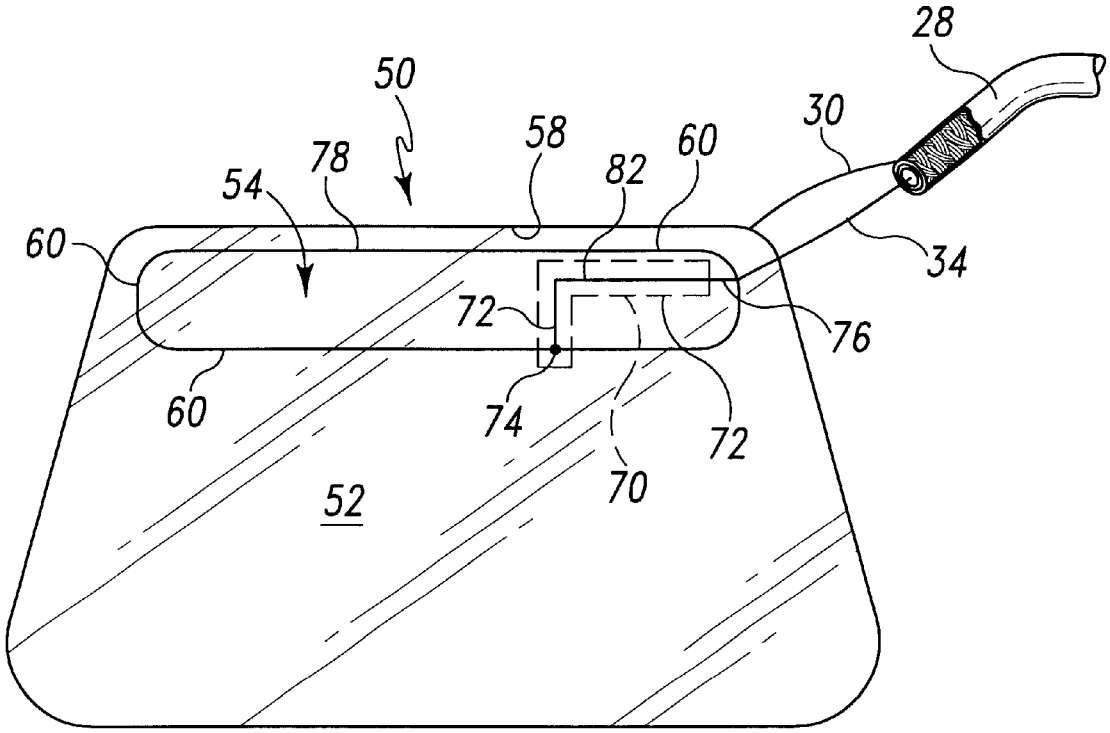
FIG. 3 discloses one alternative slot antenna design of the in-glass antenna system.

The preferred slot antenna 54 is conformal in that its componentry conforms to, or substantially lies in, the curvoplanar shape of the vehicle body, since it is substantially in the plane of the window 52. Referring to FIG. 3, another slot antenna 54 is illustrated that is comprised of a single in-glass antenna conductive trace 60 that is not defined by a portion of the electrically conductive window periphery 56. The purpose of this figure is to illustrate that the disclosure of defining a portion of the slot antenna 54 in the electrically conductive window periphery 56 of the window 52 is by way of example only, and should not be construed as a limitation of the present invention. As such, as illustrated in FIGS. 2 and 3, the in-glass slot antenna 54 may be entirely installed in the window 52 or only partially installed in the window 52 in varying embodiments of the present invention. As such, the term in-glass slot antenna as used herein should be construed broadly to include any type of configuration of a slot antenna that is at least partially installed in-glass.

Referring to FIGS. 2–3, wherein like elements are numbered the same for reference unless otherwise specified, an in-glass impedance matching circuit 70 is connected to the antenna conductive trace 60 of the in-glass slot antenna 54. As illustrated, the in-glass impedance matching circuit 70 is positioned within the window 52 or in-glass, like the antenna conductive trace 60. The preferred in-glass impedance matching circuit 70 comprises a second in-glass conductive trace 72 that includes a first end 74 that is electrically connected to conductive trace 60 and an input end 76 attached to the second conductor 34 of the electrical lead 28. Note, although it is not illustrated herein, the first end 74 of matching circuit 70 can alternatively be connected to an antenna feed structure in place of conductive trace 60 or its equivalent, which may reside within the in-glass slot antenna 54. The input end 76 of the second conductive trace 70 may be directly connected to an antenna module, the second conductor 34 (as illustrated) or the radio receiver. Although not illustrated, the second in-glass conductive trace 72 can take several different shapes, depending on the requirements of the radio system and the window 52 designs.

As briefly set forth above, the in-glass antenna system 50 of the present invention includes an impedance matching circuit 70, which is installed in-glass. The impedance matching circuit 70 is adjusted during manufacture to match the impedance of the in-glass slot antenna 54 with the radio receiver or antenna module. In the preferred embodiment of the present invention, the second in-glass conductive trace 72 is used to adjust the impedance of the in-glass slot antenna 54. Three parameters of the second in-glass conductive trace 72 are capable of being adjusted during design to thereby adjust the impedance of the in-glass slot antenna 54.

The first parameter that can be used to adjust the impedance of the in-glass slot antenna 54 is the distance that the second in-glass conductive trace 72 travels across the horizontal portion 58 of the window 52. The second parameter that can be used to adjust the impedance of the in-glass slot antenna 54 in the preferred embodiment of the invention is the distance a horizontal portion 82 of the second in-glass conductive trace 72 is placed from the horizontal portion 58 of the electrically conductive window periphery 56 (see FIG. 2) or an upper portion 78 of the in-glass slot antenna 54 (see FIG. 3). The third parameter that can be adjusted to thereby adjust the impedance of the in-glass slot antenna 54 is the width of the second in-glass conductive trace 72. As such, the present invention provides three additional dimensions of freedom to an in-glass slot antenna 54 to facilitate impedance matching of the in-glass antenna system 50 with an FM radio receiver.

As illustrated in FIGS. 2–3, in the preferred embodiment of the present invention the second conductor 34 of the electrical lead 28 is connected to the input end 76 of the second in-glass conductive trace 72. The first conductor 30 of the electrical lead 28 is preferably connected to the electrically conductive periphery 56 of the window opening; however, as illustrated in FIG. 3, the first conductor 30 may also be connected to a predetermined portion of the in-glass slot antenna 54 in alternative embodiments. As illustrated in FIGS. 2–3, the preferred second in-glass conductive trace 72 is L-shaped; however, those skilled in the art should recognize that other shapes may be used as well. Although the electrical lead 28 is used in the embodiments depicted in FIGS. 2–3, those skilled in the art should recognize that the input end 76 of the second in-glass conductive trace 72 may be connected to an antenna module (not illustrated), thereby eliminating the need for the electrical lead 28.

While the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. An in-glass FM antenna system with adjustable impedance for a window, comprising:

an in-glass FM slot antenna defined by an upper portion, a lower portion and two respective side portions of an electrically conductive member; and an in-glass impedance matching circuit connected to said in-glass slot antenna, said in-glass impedance matching circuit being located within said in-glass FM slot antenna, wherein said in-glass impedance matching circuit is capable of adjusting the impedance of said in-glass FM slot antenna.

2. The in-glass antenna system of claim 1, wherein said impedance matching circuit comprises an in-glass conductive trace connected to predetermined point on the lower portion of the electrically conductive member of said in-glass FM slot antenna.

3. The in-glass antenna system of claim 2, wherein said in-glass conductive trace runs substantially parallel with the lower portion of said in-glass slot antenna.

4. The in-glass antenna system of claim 2, wherein the length of said in-glass conductive trace is adjusted to adjust the impedance of said in-glass FM slot antenna.

5. The in-glass antenna system of claim 2, wherein the width of said in-glass conductive trace is adjusted to adjust the impedance of said in-glass FM slot antenna.

6. The in-glass antenna system of claim 2, wherein a first end of said in-glass conductive trace is connected to a predetermined point on said in-glass slot antenna.

7. The in-glass antenna system of claim 2, wherein a second end of said in-glass conductive trace is routed out of said window and used as a radio signal transmission line.

8. An in-glass FM antenna system with adjustable impedance for a window, comprising:

an in-glass FM slot antenna comprised at least in part of an in-glass antenna conductive trace that runs substantially parallel with a horizontal portion of said window;

a second in-glass conductive trace connected to said in-glass antenna conductive trace that runs substantially parallel with the horizontal portion of said window for a predetermined distance, said second conductive trace being located within said in-glass FM slot antenna, wherein a first end of said second in-glass conductive trace is grounded and a second end of said second in-glass conductive trace is used as a radio signal transmission line; and wherein said predetermined distance, the spacing of said second conductive trace from an edge of said window and the width of said second in-glass conductive trace are adjusted to thereby adjust the impedance of said in-glass FM slot antenna.

9. An in-glass FM antenna system with adjustable impedance for a window, comprising:

an in-glass FM slot antenna that is comprised at least in part of an in-glass antenna conductive trace that runs substantially parallel with a horizontal portion of said window;

a second in-glass conductive trace connected to said in-glass antenna conductive trace that runs substantially parallel with the horizontal portion of said window for a predetermined distance, said second conductive trace being located within said in-glass FM slot antenna, wherein a first end of said second in-glass conductive trace is grounded and a second end of said second in-glass conductive trace is used as a radio signal transmission line; and wherein said predetermined distance is adjusted thereby adjusting the impedance of said in-glass FM slot antenna.

10. The in-glass antenna system of claim 9, wherein the spacing of said second in-glass conductive trace from the horizontal portion of said window is adjusted to adjust the impedance of said in-glass FM slot antenna.

11. The in-glass antenna system of claim 9, wherein the width of said second in-glass conductive trace from the horizontal portion of said window is adjusted to adjust the impedance of said in-glass FM slot antenna.

12. An in-glass FM antenna system with adjustable impedance for a window, comprising:

an in-glass FM slot antenna that is comprised at least in part of an in-glass antenna conductive trace that runs substantially parallel with a horizontal portion of said window;

a second in-glass conductive trace connected to said in-glass antenna conductive trace that runs substantially parallel with the horizontal portion of said window for a predetermined distance, said second conductive trace being located within said in-glass FM slot antenna, wherein a first end of said second in-glass conductive trace is grounded and a second end of said second in-glass conductive trace is used as a radio signal transmission line; and wherein the spacing of said second in-glass conductive trace from the horizontal portion of said window is adjusted to thereby adjust the impedance of said in-glass FM slot antenna.

13. The in-glass antenna system of claim 12, wherein said predetermined distance is adjusted to adjust the impedance of said in-glass FM slot antenna.

14. The in-glass antenna system of claim 12, wherein the width of said second in-glass conductive trace is adjusted to adjust the impedance of said in-glass FM slot antenna.

15. An in-glass FM antenna system with adjustable impedance for a window, comprising:

an in-glass FM slot antenna comprised at least in part of an in-glass antenna conductive trace that runs substantially parallel with a horizontal portion of said window;

a second in-glass conductive trace connected to said in-glass antenna conductive trace that runs substantially parallel with the horizontal portion of said window for a predetermined distance, said second conductive trace being located within said in-glass FM slot antenna, wherein a first end of said second in-glass conductive trace is grounded and a second end of said second in-glass conductive trace is used as a radio signal transmission line; and wherein the width of said second in-glass conductive trace can be adjusted, thereby adjusting the impedance of said in-glass FM slot antenna.

16. The in-glass antenna system of claim 15, wherein said predetermined distance is adjusted to adjust the impedance of said in-glass FM slot antenna.

17. The in-glass antenna system of claim 15, wherein the spacing of said second in-glass conductive trace from the horizontal portion of said window is adjusted to thereby adjust the impedance of said in-glass FM slot antenna.

18. A method of providing an in-glass FM antenna system with adjustable impedance for impedance matching in a window, comprising:

providing a FM slot antenna including an in-glass antenna conductive trace that runs substantially parallel with a horizontal plane of said window;

positioning an in-glass second conductive trace within said FM slot antenna;

connecting said in-glass second conductive trace to said in-glass antenna conductive trace that runs substantially parallel with the horizontal plane of said window for a predetermined distance, wherein a first end of said second conductive trace is grounded and a second end of said second conductive trace is used as a radio signal output line; and adjusting the impedance of said FM slot antenna by adjusting said predetermined distance, the spacing of said in-glass second conductive trace from an edge of said window and the width of said in-glass second conductive trace.

* * * * *